US007836947B2

(12) United States Patent
Booth

(10) Patent No.: US 7,836,947 B2
(45) Date of Patent: Nov. 23, 2010

(54) CLEANING DEVICE FOR DOWNHOLE TOOLS

(76) Inventor: Richard Keith Booth, 8a The Village Walk, Onchan, Isle of Man (GB) IM3 4EM ( * ) Notice: Subject to any disclaimer, the term of this patent is extended or adjusted under 35 U.S.C. 154(b) by 461 days.

(21) Appl. No.: 11/820,484

(22) Filed: Jun. 19, 2007

(65) Prior Publication Data

US 2008/0010765 A1 Jan. 17, 2008

(51) Int. Cl.
*E21B 37/02* (2006.01)
*E21B 37/00* (2006.01)

(52) U.S. Cl. ..... 166/175; 166/170; 166/173; 166/311

(58) Field of Classification Search ..... 166/311, 166/26, 170, 173, 175, 205, 227
See application file for complete search history.

(56) References Cited

U.S. PATENT DOCUMENTS

| | | | | |
|---|---|---|---|---|
| 3,721,307 | A | 3/1973 | Mayo | |
| 4,190,300 | A * | 2/1980 | Scalzi | 166/208 |
| 6,371,224 | B1 | 4/2002 | Freeman et al. | |
| 6,464,003 | B2 * | 10/2002 | Bloom et al. | 166/212 |
| 2001/0022223 | A1 | 9/2001 | Howlett | |
| 2004/0094302 | A1 | 5/2004 | Booth | |
| 2005/0205252 | A1 | 9/2005 | Tulloch et al. | |

FOREIGN PATENT DOCUMENTS

| | | | |
|---|---|---|---|
| GB | 2 054 064 | A | 2/1981 |
| GB | 2216 961 | A | 10/1989 |
| GB | 2398 587 | A | 8/2004 |
| WO | WO 02/035055 | A1 | 5/2002 |
| WO | WO 03/006787 | A1 | 6/2002 |

* cited by examiner

*Primary Examiner*—Jennifer H Gay
*Assistant Examiner*—Brad Harcourt

(57) ABSTRACT

A cleaning device connectable to a downhole tool for use within a well bore, the cleaning device comprising: a base member non-rotatably mountable to the downhole tool; and at least one sleeve member rotatably mountable to and around the base member, the sleeve member having a support member and at least one protruding member which protrudes from the support member and which, in use, contacts an inner surface of the well bore, wherein the support member comprises a bearing material.

25 Claims, 5 Drawing Sheets

CLEANING DEVICE FOR DOWNHOLE TOOLS

BACKGROUND OF THE INVENTION

1. Field of the Invention

The present invention relates to cleaning devices for downhole tools. In particular, but not exclusively, the invention relates to scraper devices having an improved bearing arrangement, the scraper devices being connectable within a drill string.

2. Brief Discussion of the Related Art

During oil and gas exploration and extraction, a drill string is rotated to form a well bore. The bore is often lined using a casing which generally comprises a number of steel pipes that are connected together as they are run into the bore. A number of different devices may be attached within the drill string, such as cleaning tools, collecting tools and impellers.

When rotating the drill string, it is often undesirable for the attached device to be rotated with the drill string. In some cases, the device may be in contact with the internal diameter of the casing. Rotation of the device relative to the casing may therefore result in wear to the device and/or to the internal diameter of the casing.

In order to avoid unnecessary wear, the device may be rotatably mounted relative to the drill string. This allows the drill string to rotate but the device does not rotate with the drill string.

One such type of device is a scraper tool which is used to clean the internal diameter of the casing in a well during longitudinal movement of the drill string. Typically, the scraper tool comprises a cylindrical body and a number of scraping blades extending from the cylindrical body. The scraping blades contact the casing to allow cleaning of the internal surface of the casing during vertical movement of the drill string. The cylindrical body is rotatably mounted relative to the drill string so that, if the drill string is rotated, the cylindrical body and the scraping blades do not. This arrangement avoids unnecessary wear to the scraping blades and/or to the internal surface of the casing as the scraping blades are not forced to rotate with respect to the casing.

However, one disadvantage inherent in the scraper tool being rotatably mounted relative to the drill string is that, upon rotation of the drill string, friction may occur at the interface of rotating (drill string) and non-rotating (cylindrical body) parts. This friction can result in damage to the device or downhole tool. For instance, galling can occur when parts rotate relative to each other. Friction occurs between surface asperities, which causes heat, and the asperities may weld together. Further rotational displacement of one part relative to another causes these micro-welds to break, which makes the interface surface even rougher, resulting in greater friction between the parts.

In extreme cases, such as at excessive speeds of rotation, the heat generated by the friction during rotation may cause the rotating and non-rotating parts to weld together at a macro level. The parts are typically formed from steel. Although steel typically has a melting temperature of over 1500° C., galling can occur at much lower temperatures, such as 800° C. The fusing of parts necessitates the carrying out of repairs and/or the replacement of the tool, which is expensive and time-consuming. Conventionally, to avoid these problems, the speed of rotation of the drill string is kept below a maximum value, even though higher drilling speeds would reduce the drilling time involved.

SUMMARY OF THE INVENTION

According to a first aspect of the present invention, there is provided a cleaning device connectable to a downhole tool for use within a well bore, the cleaning device comprising:

a base member non-rotatably mountable to the downhole tool; and at least one sleeve member rotatably mountable to and around the base member, the sleeve member having a support member and at least one protruding member which protrudes from the support member and which, in use, contacts an inner surface of the well bore, wherein the support member comprises a bearing material.

Preferably the cleaning device comprises a scraper device. Preferably the protruding member comprises a scraper blade. Alternatively the cleaning device may comprise a filter tool and the protruding member comprises a frictional contact members of a valve arrangement provided at the filter tool.

Preferably the device comprises inhibiting means adapted to substantially inhibit rotation of the sleeve member relative to the downhole tool. Preferably the inhibiting means is provided by frictional contact between the protruding member and the interior surface of the well.

Preferably the device includes biasing means provided between the protruding member and the support member which, in use, biases the protruding member towards the inner surface of the well bore. Alternatively the protruding member and the support member may be fixed relative to each. Alternatively the protruding member and the support member may be integral.

Preferably the support member includes a plurality of protruding members, Preferably four protruding members are provided.

Preferably the support member comprises one or more rings, each ring supporting at least one protruding member. Preferably a plurality of rings are provided. Preferably the rings are sequentially and axially arranged along the base member.

Preferably adjacent rings are arranged such that the protruding members of adjacent rings are circumferentially offset from each other. This ensures that an even scraping action is achieved around the circumference of the well bore. Preferably each ring comprises means to prevent rotation relative to an adjacent ring.

Preferably each protruding member is provided with a downwardly orientated cutting blade. Preferably the upper edge of each chisel blade is tapered away from the casing wall. This allows the chisel blade to slide over any material protruding from the wall of the casing when the chisel blade is moved upwardly relative to the casing wall.

Preferably the protruding member includes a substantially planar base surface and the support member includes at least one planar land for the protruding member. Preferably the support member defines at least one recess for receiving the protruding member. Preferably the recess defines the planar land.

Preferably the sleeve member includes a housing member fixedly attachable to the support member and adapted to retain the protruding member to the support member. Preferably the housing member includes at least one aperture alignable with the recess such that the protruding member may protrude from the support member and through the aperture to contact the inner surface of the well bore.

Preferably one of the base member and the sleeve member includes a lubricant reservoir in fluid communication with an interface of the base member and sleeve member such that rotation of the base member relative to the sleeve member lubricates the interface. Preferably the lubricant reservoir is provided at the base member and the base member includes a piston which acts on the lubricant reservoir to apply lubricant to the interface. Preferably the base member includes at least one transverse channel in fluid communication with a bore of the downhole tool and the piston is arranged at the channel to be displaced by pressure from fluid within the bore of the downhole tool and thereby act on the lubricant reservoir to apply lubricant to the interface.

Preferably the bearing material comprises a non-ferrous alloy. Preferably the bearing material comprises a copper alloy. Preferably the bearing material comprises copper beryllium. Alternatively, the bearing material comprises brass.

Preferably the bearing material is provided at an inner surface of the support member. Due to its material properties, the use of a bearing material such as brass or copper beryllium inhibits the outer surface of the base member and the inner surface of the support member from welding together.

The bearing material may be in the form of a coating provided at the inner surface of the support member. It is to be appreciated that embodiments of the invention may vary from an embodiment which includes only a coating formed from the bearing material to an embodiment in which a number of components of the support member, or the whole support member, are formed from the bearing material.

The outer surface of the base member may also be formed from a bearing material. The bearing material of the outer surface of the base member may be the same or different to the bearing material of the support member. The bearing material of the outer surface of the base member may be in the form of a coating.

Preferably the base member is non-axially movable relative to the downhole tool. Preferably the support member is non-axially movable relative to the base member. Alternatively the support member may be slidably mounted to the base member.

Preferably the base member and the support member are spaced apart by a distance when the base member and the support member are concentric. Preferably the distance is between 0.3 and 1 mm, most preferably 0.5 mm. This distance allows expansion of the base member without frictional contact between the base member and the support member when the downhole tool is rotated at higher than conventional speeds.

According to a second aspect of the present invention, there is provided a downhole tool for use within a well bore, the downhole tool including at least one cleaning device according to a first aspect of the present invention.

According to a third aspect of the present invention, there is provided a method of assembling a downhole tool including a scraper device, the method comprising the steps of:

providing an annular housing member including at least one aperture provided at the circumference of the housing member;

providing at least one protruding member having a base flange and a scraper blade protruding from the base flange;

inserting the protruding member through the aperture from within bore of the annular housing member until the base flange contacts the inner surface of the bore of the annular housing member;

non-rotatably mounting the housing member and inserted protruding member to and around a support member, thus retaining the protruding member to the support member and housing member; and rotatably mounting the assembled housing member and inserted protruding member and support member to the downhole tool.

Preferably the method includes forming at least one recess at the support member such that the recess aligns with the aperture and such that the protruding member may protrude from the recess and through the aperture.

Preferably the method includes providing biasing means between the protruding member and the support member to bias the protruding member away from the support member.

Preferably the support member comprises one or more rings, each ring supporting at least one protruding member. Preferably a plurality of rings are provided. Preferably the method includes arranging the rings sequentially and axially along the downhole tool. Preferably the method includes arranging adjacent rings such that the protruding members of adjacent rings are offset from each other.

Preferably the method includes non-rotatably mounting a base member to the downhole tool. Preferably the method includes rotatably mounting the assembled housing member and inserted protruding member and support member to the base member.

Preferably at least one of the base member and support member comprises a bearing material. Preferably the bearing material comprises a non-ferrous alloy. Preferably the bearing material comprises a copper alloy. Preferably the bearing material comprises copper beryllium. Alternatively, the bearing material comprises brass.

Preferably the method includes spacing apart the base member and the support member by a distance when the base member and the support member are concentric. Preferably the distance is between 0.3 and 1 mm, most preferably 0.5 mm.

According to a fourth aspect of the present invention, there is provided a cleaning device connectable to a downhole tool for use within a well bore, the cleaning device comprising:

a base member non-rotatably mountable to the downhole tool; and at least one sleeve member rotatably mountable to and around the base member, wherein one of the base member and the sleeve member includes a lubricant reservoir in fluid communication with an interface of the base member and sleeve member such that rotation of the base member relative to the sleeve member lubricates the interface.

Preferably the lubricant reservoir is provided at the base member and the base member includes a piston which acts on the lubricant reservoir to apply lubricant to the interface. Preferably the base member includes at least one transverse channel in fluid communication with a bore of the downhole tool and the piston is arranged at the channel to be displaced by pressure from fluid within the bore of the downhole tool and thereby act on the lubricant reservoir to apply lubricant to the interface.

Preferably the sleeve member comprises a support member and at least one protruding member which protrudes from the support member and which, in use, contacts an inner surface of the well bore.

Preferably the support member comprises a bearing material. Preferably the bearing material comprises a non-ferrous alloy. Preferably the bearing material comprises a copper alloy. Preferably the bearing material comprises copper beryllium. Alternatively, the bearing material comprises brass.

Preferably the cleaning device comprises a scraper device. Preferably the protruding member comprises a scraper blade.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
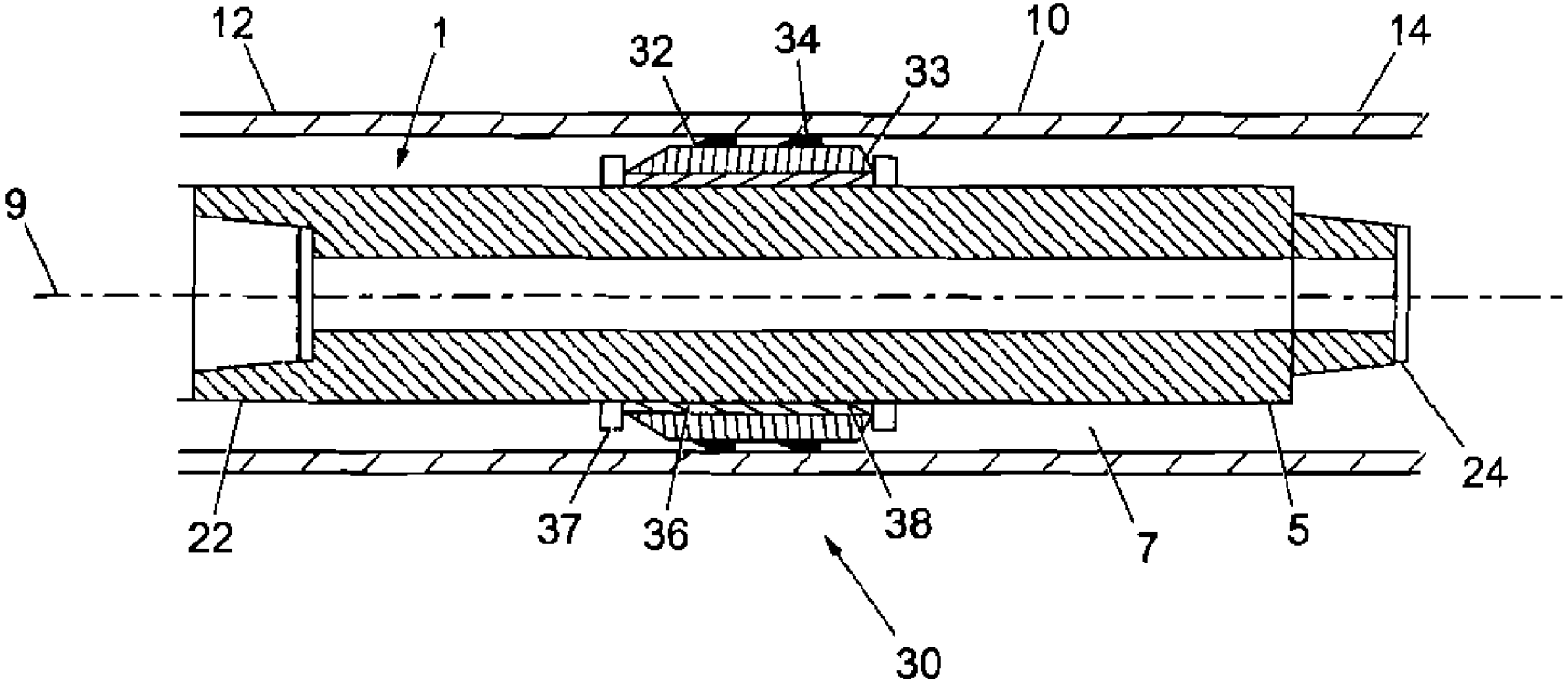
FIG. 1 is a longitudinal sectional view of a downhole tool within a casing having a cleaning device according to a first embodiment of the present invention attached thereto.

FIG. 1 shows a first embodiment of a downhole tool 1 within a casing 10 comprising a string 5 on which is provided a cleaning device in the form of a scraper tool 30. In this embodiment, the device 30 includes a cylindrical sleeve 32 mountable to the drill string 5.

Figure 2:
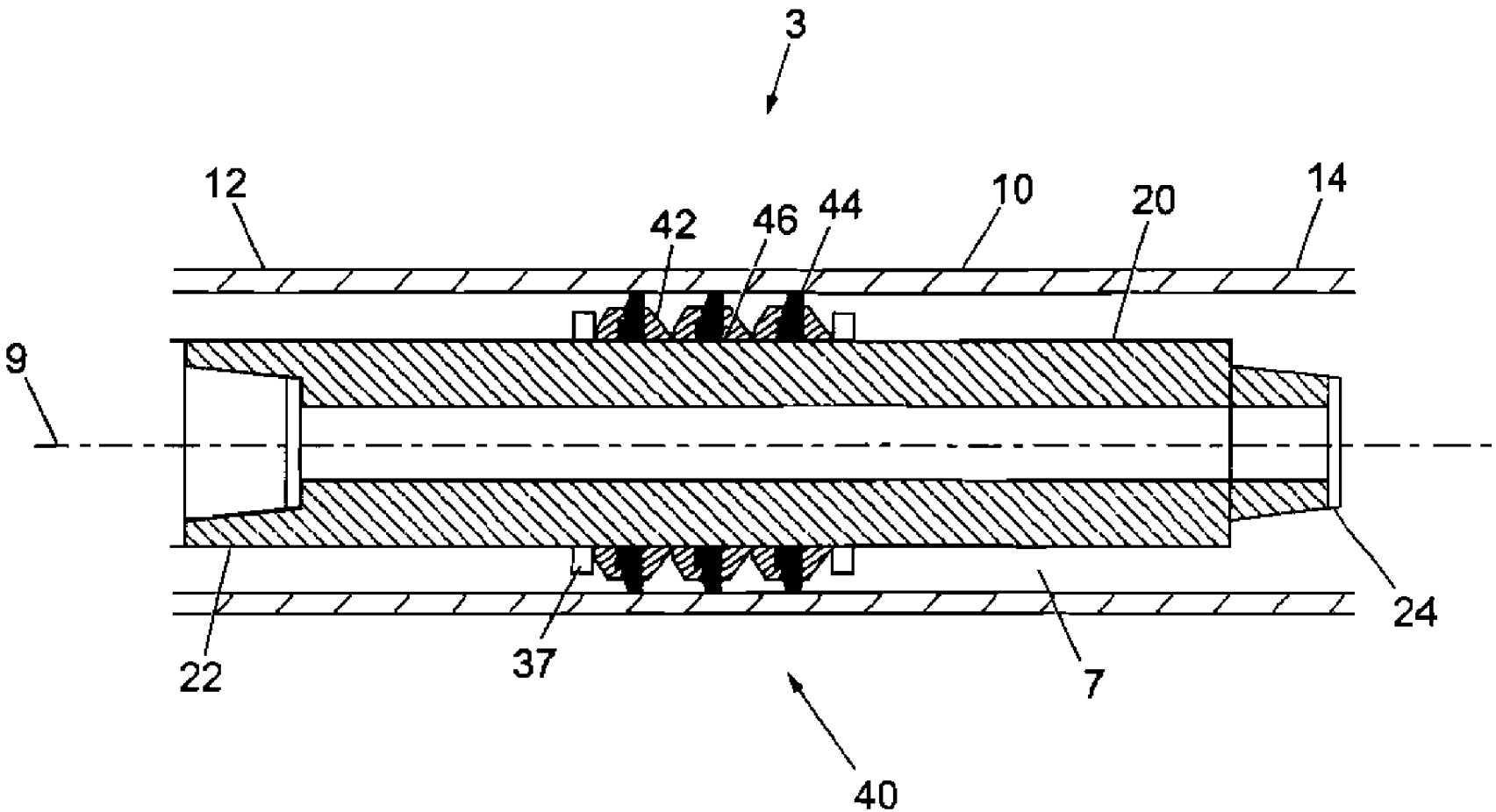
FIG. 2 is a longitudinal sectional view of a cleaning device according to a second embodiment of the present invention.
Figure 3:
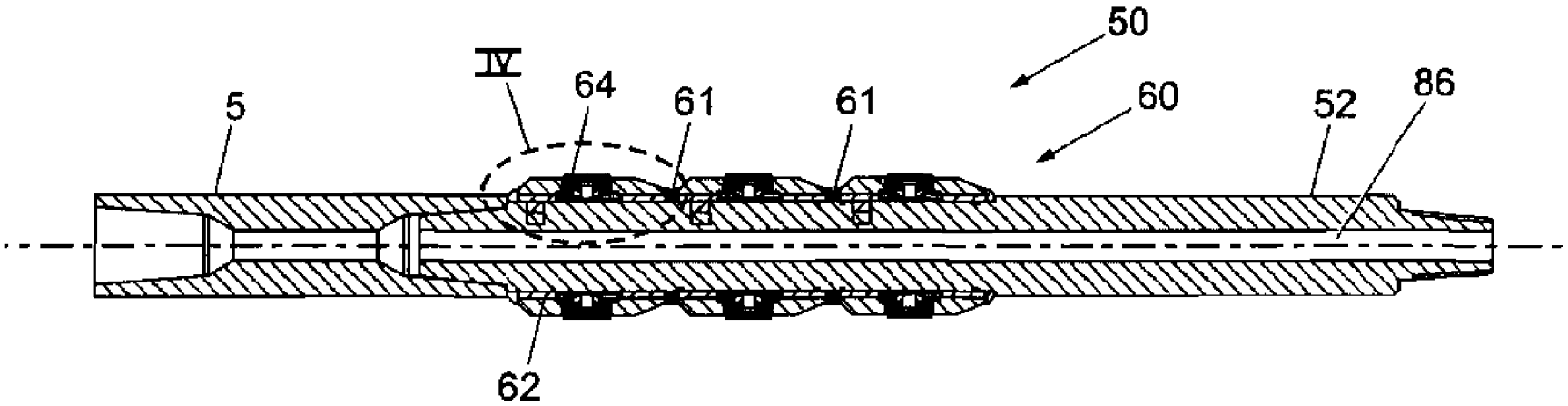
FIG. 3 is another longitudinal sectional view of a downhole tool having a cleaning device according to a third embodiment of the present invention attached thereto.

FIG. 2 shows a second embodiment of a device, also in the form of a scraper tool 3, within a casing 10 comprising a base member or cylindrical body 20 on which is provided a scraper blade assembly 40. In this embodiment, the cylindrical body 20 forms a longitudinal component of the drill string. The cylindrical body 20 is provided with connecting means in the form of threaded connectors 22, 24 for connection to adjacent drill pipes or adjacent downhole tools forming the drill string.

Referring first of all to both FIGS. 1 and 2, the casing 10 is comprised of a number of longitudinal sections (not shown) which are connected together so that the casing 10 may be vertically inserted into a borehole (not shown). The casing 10 therefore has an upper end 12 and a lower end 14. The casing 10 is typically set in the borehole by cementing the space between the borehole and the casing. However, the cementing process may leave cement deposits within the casing 10 and at the bottom of the borehole. It is desirable to scrape away these cement deposits and then to collect and remove them from the borehole.

Referring now to FIG. 1, the scraper tool 30 comprises a sleeve 32 rotatably mounted to a base member 36 fixed to the drill string 5. The sleeve 32 has a support member 33 and a number of protruding members or blades 34 protrude from the support member 33 and make contact with the internal surface of the casing 10. The blades 34 are arranged to cut material protruding from the internal wall of the casing 10 when the scraper tool 30 is moved downwardly relative to the casing 10. A number of stops 37 are provided to prevent longitudinal movement of the sleeve 32 relative to the drill string 5.

Frictional contact between the blades 34 and the internal surface of the casing 10 provides inhibiting means to substantially inhibit rotation of the sleeve 32 relative to the drill string 5 and also the casing 10. The sleeve 32 includes a support member 33 which is a cylindrical insert which prevents direct contact between the main body of the sleeve 32 and the drill string 5. The support member 33 is comprised of a bearing material, such as brass or copper beryllium. This substantially reduces friction between the drill string 5 and the sleeve 32 during rotation of the drill string 5 relative to the sleeve 32. Also, wear to the drill string 5 and sleeve 32 is reduced or prevented. Furthermore, the interface member 38 prevents the sleeve 32 from becoming welded onto the drill string 5.

Referring now to FIG. 2, the scraper tool 40 comprises three scraper rings or sleeves 42 rotatably mounted on the cylindrical body 20. Each sleeve 42 has a number of scrapers including blades 44 for removing material from the interior surface of the casing 10. Each blade 44 is held within a housing or mounting block (not shown) and is spring-mounted by means of a spring (not shown) to the scraper sleeve 42. The spring ensures that the blade 44 remains in contact with the casing 10.

The scraper sleeves 42 are rotatably mounted on the body 20 such that the cylindrical body 20 may rotate but the scraper sleeves 42 do not rotate about a longitudinal axis 9. A number of stops 37 prevent longitudinal movement of the sleeves 42 relative to the drill string 5. Frictional contact between the chisel blades 44 and the interior surface of the casing 10 provides inhibiting means to substantially inhibit rotation of the scraper sleeves 42 about the longitudinal axis 9. The scraper sleeves 42 are comprised of a bearing material such as brass or copper beryllium.

FIGS. 3 to 6 show a third embodiment of the invention. The scraper device 50 is connected to a downhole tool 5 for use within a well bore. The device 50 comprises three rings or sleeves 60 arranged sequentially and axially along a base member 52 which is non-rotatably mounted to the downhole tool 5. The three sleeves 60 are rotatably mounted around the base member 52 but are non-movable relative to each other as they are fixedly connected using locking dogs 61.

Each sleeve 60 has a support member 62 and four protruding members or blades 64 which protrudes from the support member 62 and which, in use, contact the inner surface of the well bore. The blades 64 also provide inhibiting means to inhibit rotation of the sleeve 60 relative to the downhole tool 5. Adjacent sleeves 60 are arranged such that their blades 64 are circumferentially offset from each other. Each blade 64 is provided with a downwardly orientated cutting blade and the upper edge of each blade 64 is tapered away from the casing wall. In an alternative embodiment, the three sleeves 60 may share a common support member 62.

Figure 4:
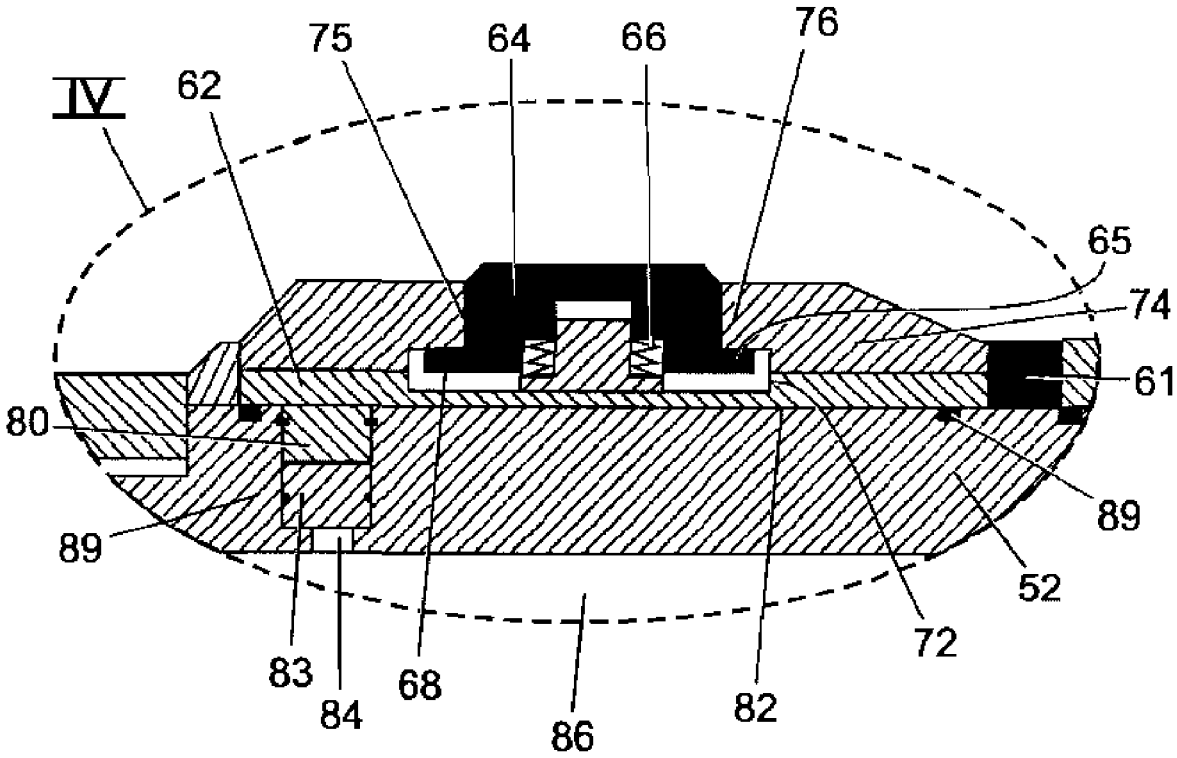
FIG. 4 is a detailed longitudinal sectional view of the cleaning device shown in FIG. 3.
Figure 5:
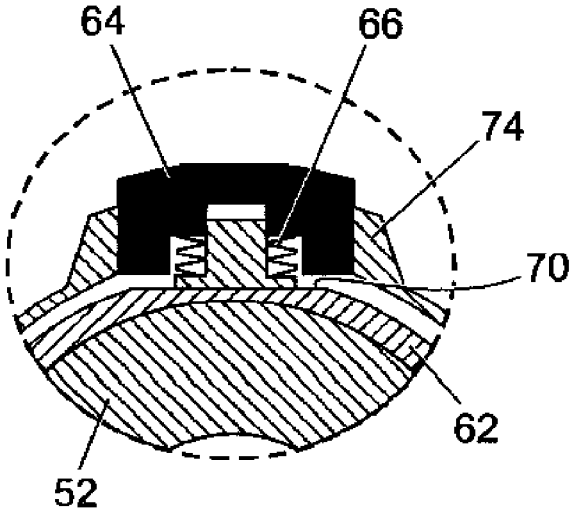
FIG. 5 is a detailed sectional end view of the cleaning device shown in FIG. 3.

As shown in FIGS. 4 and 5, each blade 64 has a flat base surface 68 and is provided in a recess 72 of the support member 62. Each recess 72 defines a flat land 70 for each blade 64. Biasing means in the form of a compression spring 66 is provided between the blades 64 and the support member 62 to bias the blades 64 away from the support member 62 and towards the inner surface of the well bore.

A housing member 74 is fixedly attachable to the support member 62. The housing member 74 includes an aperture 75 aligned with the recess 72 for receiving the blade 64 there through. The housing member 74 also includes a flange 76 which engages with a lip 65 of the blade 64 to limit the travel of the biased blade 64 and thereby retain the blade 64 to the support member 62.

The base member 52 includes a lubricant reservoir 80 in fluid communication with the interface 82 of the base member 52 and support member 62. The reservoir 80 is provided in a transverse channel 84 which is in fluid communication with the bore 86 of the scraper device 50 and the downhole tool 5. A piston 88 is provided in the transverse channel 84 between the lubricant reservoir 80 and the bore 86. Pressure from fluid within the bore 86 can displace the piston 88 to act (or at least cause the piston 88 to maintain a pressure) upon the lubricant reservoir 80 to apply lubricant to the interface 82. A number of O-rings 89 are provided at suitable locations to retain the applied lubricant at the interface 82. Rotation of the base member 52 relative to the support member 62 assists in lubricating the interface 82.

The support member 62 is formed from a bearing material such as copper beryllium or brass. Alternatively the support member 62 could be formed from another material and a coating of bearing material could be provided at the inner surface of the support member 62.

Although not apparent from the drawings, the base member 52 and the support member 62 are spaced apart by a distance of about 0.5 mm. This distance allows expansion of the base member 52 without frictional contact between the base member 52 and the support member 62 when the downhole tool is rotated at higher than conventional speeds.

A downhole tool including a scraper device 50 is assembled as follows. The housing member 74 is formed as an annular sleeve and including apertures 75 at specific locations at the circumference of the housing member 74. A blade 64 which has been formed to have the base flange 65 is inserted through each aperture 75 from within the bore of the annular housing member 74 until the base flange 65 contacts the inner surface of the bore of the housing member 74.

The housing member 74 and inserted blades 64 are then non-rotatably mounted to the support member 62 while aligning the blades 64 in the recesses 72 and providing the spring 66 between each blade 64 and recess 72. Each blade 64 is now retained at the support member 62.

Figure 6:
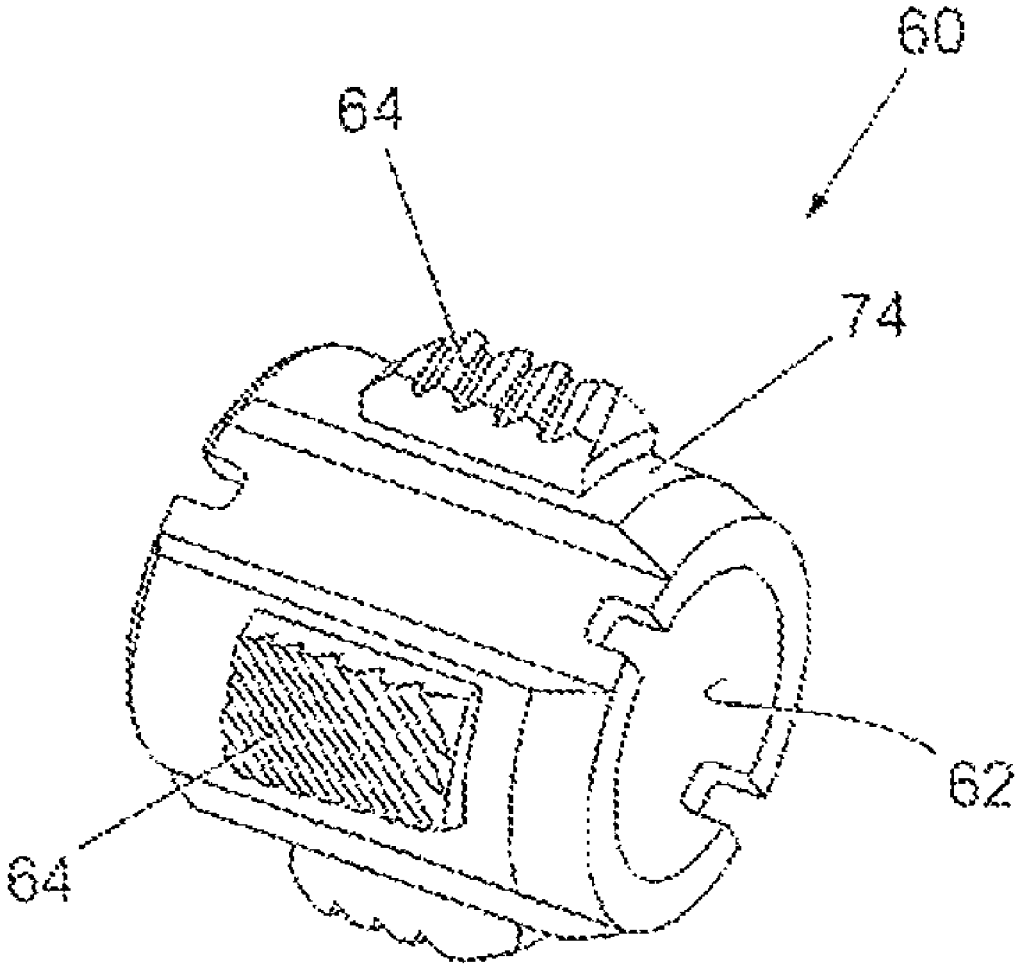
FIG. 6 is a perspective view of a component of the cleaning device shown in FIG. 3.

The assembled sleeve 60 comprising the housing member 74, blades 64 and support member 62 is shown in FIG. 6. The assembled sleeve 60 is then rotatably mounted to the base member 52 which is fixed to the downhole tool 5.

This is repeated until three sleeves 60 are sequentially and axially arranged along the base member 52. The sleeves are also arranged such that the blades 64 of adjacent sleeves 60 are circumferentially offset from each other.

During a downhole cleaning operation, a drill string 5 is assembled to include a scraper tool 30, 40, 50. The drill string 5 is lowered into the casing 10. The downward urging of the drill string 5 provides a scraping action to the interior surface of the casing 10. During rotation of the drill string 5, frictional contact of the scraping blades 34, 44, 64 and the inner wall of the casing 10 tends to inhibit rotation of the scraping blades 34, 44, 64 relative to the casing 10, although there may be some rotational slippage. Thus, the drill string 5 rotates but the scraping blades do not.

The provision of a bearing material at the interface 36, 46, 82 allows the drill string 5 to rotate without generating large amounts of friction at the interface 36, 46. The provision of the lubricating system also reduces the friction generated. This allows higher than conventional drilling speeds to be used.

The construction of the device 30, 40, 50 and the manner of assembly also offer improved retention of the blades 34, 44, 64, and improved supporting of the device to the tool (or base member) while still offering easy replacement of the blades or one of the sleeves 42, 60 or the whole device.

Various modifications and improvements can be made without departing from the scope of the present invention.

The invention claimed is:

1. A cleaning device connectable to a downhole tool for use within a well bore, the cleaning device comprising:

a base member non-rotatably mountable to the downhole tool; and at least one sleeve member rotatably mountable to and around the base member, the sleeve member having a housing member, a support member, at least one protruding member, and a biasing device provided between the protruding member and the support member, wherein the support member has an outer surface, the housing member is fixedly attachable to the outer surface of the support member so that the support member is disposed between the base member and the housing member, the housing member having an aperture, and being configured to retain the protruding member on the support member whereby the protruding member protrudes through the aperture on the housing member and, in use, is biased by the biasing device towards and into contact with an inner surface of the well bore, wherein the base member has an outer surface, the support member comprises an annular sleeve surrounding the base member, the annular sleeve having an inner surface comprising a bearing material to bear against the outer surface of the base member.

2. A cleaning device as claimed in claim 1, wherein the cleaning device comprises a scraper device, and wherein the protruding member comprises a scraper blade.

3. A cleaning device as claimed in claim 1, wherein the cleaning device comprises a filter tool, and wherein the protruding member comprises a frictional contact member of a valve arrangement provided at the filter tool.

4. A cleaning device as claimed claim 1, wherein the protruding member is adapted to substantially inhibit rotation of the sleeve member relative to the inner surface of the well bore.

5. A cleaning device as claimed in claim 1, wherein the support member comprises at least one ring, the ring supporting at least one protruding member.

6. A cleaning device as claimed in claim 5, wherein the support member comprises a plurality of rings, and wherein the rings are sequentially and axially arranged along the base member.

7. A cleaning device as claimed in claim 6, wherein the rings are arranged such that the protruding members of adjacent rings are circumferentially offset from each other.

8. A cleaning device as claimed in claim 1, wherein the protruding member includes a substantially planar base surface and the support member includes at least one planar land for the protruding member.

9. A cleaning device as claimed in claim 8, wherein the support member defines at least one recess for receiving the protruding member, and wherein the recess defines the planar land.

10. A cleaning device as claimed in claim 9, wherein the aperture in the housing member is alignable with the recess such that the protruding member may protrude from the support member and through the aperture to contact the inner surface of the well bore.

11. A cleaning device as claimed in claim 1, wherein one of the base member and the sleeve member includes a lubricant reservoir in fluid communication with an interface of the base member and sleeve member such that rotation of the base member relative to the sleeve member lubricates the interface.

12. A cleaning device as claimed in claim 11, wherein the lubricant reservoir is provided at the base member and the base member includes a piston which acts on the lubricant reservoir to apply lubricant to the interface.

13. A cleaning device as claimed in claim 12, wherein the base member includes at least one transverse channel in fluid communication with a bore of the downhole tool, and wherein the piston is arranged at the channel to be displaced by pressure from fluid within the bore of the downhole tool and thereby act on the lubricant reservoir to apply lubricant to the interface.

14. A cleaning device as claimed in claim 1, wherein the bearing material comprises a copper alloy.

15. A cleaning device as claimed in claim 14, wherein the bearing material comprises copper beryllium.

16. A cleaning device as claimed in claim 1, wherein the support member is non-axially movable relative to the base member.

17. A cleaning device as claimed in claim 1, wherein the base member and the support member are spaced apart by a distance when the base member and the support member are concentric.

18. A cleaning device as claimed in claim 1, further including a downhole tool connectable to the cleaning device for use within a well bore.

19. A method of assembling a downhole tool including a scraper device, the method comprising the steps of:

providing an annular housing member including at least one aperture provided at the circumference of the housing member;

providing at least one protruding member having a base flange and a scraper blade protruding from the base flange;

inserting the protruding member through the aperture from within a bore of the annular housing member until the base flange contacts the inner surface of the bore of the annular housing member;

non-rotatably mounting the housing member and inserted protruding member to and around a support member, thus retaining the protruding member to the support member and housing member;

providing a biasing device between the protruding member and the support member to bias the protruding member away from the support member; and rotatably mounting the assembled housing member and inserted protruding member and support member to a cylindrical shaft of the downhole tool, wherein the support member comprises an annular sleeve surrounding the shaft of the downhole tool, the annular sleeve having an inner surface comprising a bearing material to bear against the outer surface of the shaft of the downhole tool.

20. A method as claimed in claim 19, including forming at least one recess at the support member such that the recess aligns with the aperture and such that the protruding member may protrude from the recess and through the aperture.

21. A method as claimed in claim 19, wherein the support member comprises a plurality of rings, each ring supporting at least one protruding member, and wherein the method includes arranging the rings sequentially and axially along the downhole tool such that the protruding members of adjacent rings are offset from each other.

22. A method as claimed in claim 19, including non-rotatably mounting a base member to the downhole tool, and rotatably mounting the assembled housing member and inserted protruding member and support member to the base member.

23. A method as claimed in claim 22, including spacing apart the base member and the support member by a distance when the base member and the support member are concentric.

24. A cleaning device connectable to a downhole tool for use within a well bore, the cleaning device comprising:

a base member non-rotatably mountable to the downhole tool; and at least one sleeve member rotatably mountable to and around the base member, the sleeve member comprising a housing member, a support member and at least one protruding member;

wherein the housing member is fixedly attachable to the support member, and is configured to retain the protruding member on the support member;

wherein the protruding member includes a substantially planar base surface and the support member includes at least one planar land for the protruding member, wherein the support member defines at least one recess for receiving the protruding member, and wherein the recess defines the planar land;

wherein the support member comprises a bearing material and;

wherein the housing member has an aperture alignable with the recess such that the protruding member protrudes from the support member and through the aperture to contact an inner surface of the well bore.

25. A method of assembling a downhole tool including a scraper device, the method comprising the steps of:

providing an annular housing member including at least one aperture provided at the circumference of the housing member;

providing at least one protruding member having a base flange and a scraper blade protruding from the base flange;

inserting the protruding member through the aperture from within a bore of the annular housing member until the base flange contacts the inner surface of the bore of the annular housing member;

providing a support member having at least one recess alignable with the aperture of the housing member;

non-rotatably mounting the housing member and inserted protruding member to and around the support member, and aligning the recess on the support member with the aperture such that the protruding member may protrude from the recess and through the aperture, thus retaining the protruding member to the support member and housing member; and rotatably mounting the assembled housing member and inserted protruding member and support member to the downhole tool.

* * * * *